United States Patent [19]

Jackson et al.

[11] Patent Number: 4,562,775

[45] Date of Patent: Jan. 7, 1986

[54] RAILWAY VEHICLE WITH END AND INTERMEDIATE TRUCKS

[75] Inventors: Keith L. Jackson, Creve Coeur, Mo.; W. Clifford Jones, Granite City; John L. Schauster, Highland, both of Ill.

[73] Assignee: Lukens General Industries, Inc., Coatesville, Pa.

[21] Appl. No.: 594,878

[22] Filed: Mar. 29, 1984

[51] Int. Cl.[4] ..... B61F 5/02

[52] U.S. Cl. ..... 105/186; 105/201; 105/193; 105/197 DB

[58] Field of Search ..... 105/4 A, 4 R, 185, 186, 105/193, 197 R, 197 D, 197 DB, 199 R, 199 C, 200, 201, 171–174, 175 R; 280/101

[56] References Cited

U.S. PATENT DOCUMENTS

| | | | |
|---|---|---|---|
| 1,014,362 | 1/1912 | Barber | 105/186 |
| 1,079,458 | 11/1913 | Westlake | 105/186 |
| 1,127,133 | 2/1915 | Webb | 105/186 X |
| 2,610,586 | 9/1952 | Alben | 105/198 |
| 2,829,605 | 4/1958 | Kell et al. | 105/193 X |
| 3,547,046 | 12/1970 | Lich | 105/199 R |
| 4,231,296 | 11/1980 | Jackson | 105/199 R |

*Primary Examiner*—Randolph A. Reese

*Assistant Examiner*—Glenn B. Foster

*Attorney, Agent, or Firm*—F. Travers Burgess

[57] ABSTRACT

A railway vehicle, in particular a locomotive, has three or more trucks with the bolsters of each swivelly supported on the respective truck frames and having means for transmitting longitudinal traction and braking forces to the body underframe. The truck bolsters mount upright body-support spring devices which are yieldable in shear transversely of the locomotive to permit sufficient limited lateral movement of the body with respect to the trucks to prevent the full force of lateral blows and shocks received by the wheels from being communicated to the body and for preventing the momentum of the body from acting with its full lateral force on the truck wheels and rails. The upright springs of the end trucks support the underframe directly while the upright springs of the intermediate truck or trucks support a superbolster which is movable transversely of the locomotive underframe a substantial distance in addition to the lateral deflection of the upright springs to accommodate the additional lateral movement or excursion of the intermediate truck or trucks with respect to the underframe required during operation on curved track.

36 Claims, 9 Drawing Figures

RAILWAY VEHICLE WITH END AND INTERMEDIATE TRUCKS

BACKGROUND OF THE INVENTION

1. Field of the Invention

The invention relates to railway rolling stock and consists particularly in a railway vehicle such as a locomotive having at least three swiveling trucks, and more particularly in an intermediate truck for such a vehicle.

2. The Prior Art

In the prior art, F. L. Alben U.S. Pat. No. 2,610,586 discloses trucks for three-truck locomotives in which the body bolsters transversely slidably receive a member swivelly connected to the truck frames and spring-supported thereon and slidably supporting the underframe, the last-named member being centered by horizontal transversely extending centering springs on the end trucks and being freely movable transversely on the middle truck to provide unrestricted lateral motion for operation on curved track. C. W. Kell et al U.S. Pat. No. 2,829,605 discloses a truck for three-truck locomotives in which a truck bolster is laterally movable in a pocket in a truck frame and swivels with respect to the underframe and has downwardly facing side bearings slidably engaging the truck frame and upwardly facing side bearings slidably engaging the underframe, horizontal springs centering the bolster transversely of the truck frame on the end trucks being omitted from the intermediate truck or trucks so as to accommodate freely necessary lateral excursions of the middle trucks during curved track operation. Keith L. Jackson U.S. Pat. No. 4,231,926 discloses trucks in which a bolster is spring-supported on the truck frame to provide both lateral and vertical deflection. On the end trucks, the bolster engages a swivel member on the underframe and is incapable of lateral movement with respect to the underframe, while on the intermediate trucks the bolster is connected to the underframe by a Watts linkage so as to permit substantial lateral as well as swivel movement between side bearing surfaces on the bolster and downwardly facing bearing surfaces on the underframe, such that normal lateral movement of the intermediate truck relative to the locomotive body is accommodated through lateral deflection in the bolster springs and lateral excursions are accommodated by transverse sliding of the upwardly facing side bearings on the bolster with respect to downwardly facing loading pads on the underframe.

SUMMARY OF THE INVENTION

The invention provides a locomotive with three or more trucks, of the type in which the body-support spring devices are supported on the ends of bolsters swivelly mounted on the respective truck frames, and on the end trucks the underframe is directly supported on the bolster-supported spring devices while on the intermediate truck a superbolster is directly supported on the bolster supported spring devices and is movable transversely of the locomotive underframe, there being lateral stops between the bolster and the superbolster whereby lateral movement therebetween is confined to normal lateral bolster movement while additional lateral movement between the intermediate truck and the locomotive underframe is provided by additional movement between the superbolster and the underframe, lateral resistance between the latter elements exceeding the resistance in lateral shear of the bolster-supported spring devices, whereby under normal lateral blows and shocks received by the wheel flanges from the rails during tangent track operation, the blows and shocks are absorbed through lateral deflection in the bolster-supported spring devices and lateral movement of the superbolster with respect to the underframe occurs only during curved track operation. Preferably, the laterally movable support for the underframe on the superbolster includes means for returning the superbolster to centered position transversely of the underframe following lateral excursions of the center bolster.

DETAILED DESCRIPTION OF THE INVENTION

Figure 1:
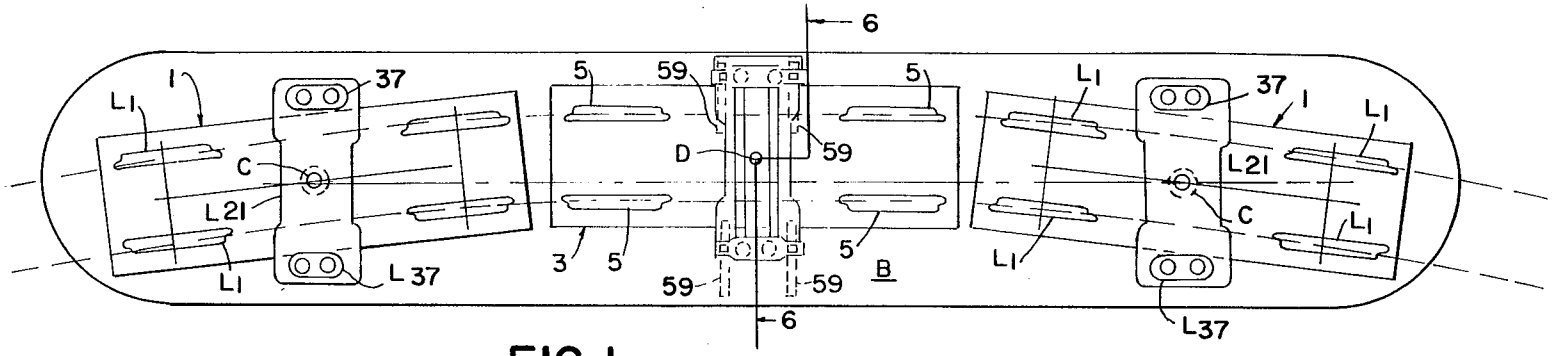
FIG. 1 is a schematic plan view of a locomotive incorporating the invention positioned on curved track.

Wherever used herein, the term "normal lateral motion" shall mean the relative transverse movement provided between the body of a vehicle and the frame of a supporting truck for the purpose of preventing the full force of lateral blows and shocks from being communicated from the rails through the wheel flanges and truck frame to the body and, vice versa, for preventing the momentum of the body from acting with its full lateral force on the truck frame, wheel flanges and rails. The term "normal lateral motion" does not refer to the full transverse movement of the intermediate truck of a vehicle having three or more trucks with respect to the vehicle body required during operation of the vehicle through track curves.

Wherever used herein, the term "lateral excursion" shall mean the distance the intermediate truck or trucks of a vehicle having three or more trucks must move transversely of the body in a direction radially outwardly of the truck during operation through track curves.

The letter B denotes a locomotive body having an underframe U supported at its ends on a pair of end trucks generally indicated at 1 in the manner of the truck disclosed in R. L. Lich U.S. Pat. No. 3,547,046, which is hereby incorporated by reference herein (Lich reference numerals having the prefix "L" wherever used herein), wherein the spring caps L37 are rigidly secured to underframe U, and on an intermediate truck generally indicated at 3. Each of the trucks is preferably of a type constructed, as will be seen in greater detail hereinbelow, to provide for transmission of traction forces substantially at rail level from the respective truck to the locomotive body so as to eliminate substantially any vertical moment arm through which these forces would otherwise tend to tip the spring-supported truck structure about a transverse axis and thereby increase the load on one of the truck axles and proportionately decrease the load on the other truck axle.

Figure 2:
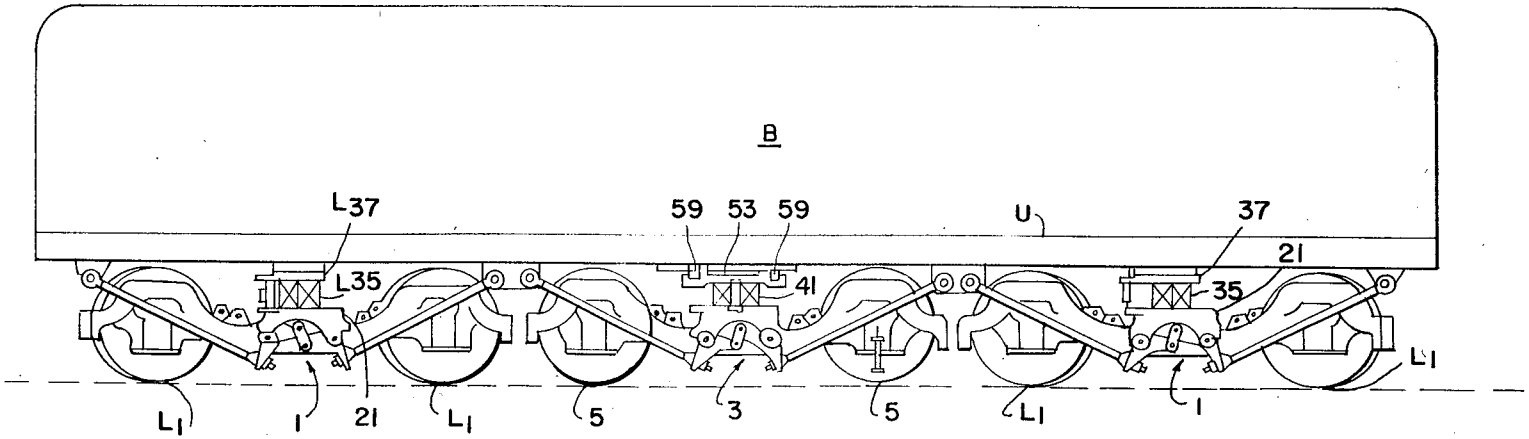
FIG. 2 is a side elevational view of the locomotive illustrated in FIG. 1.
Figure 3:
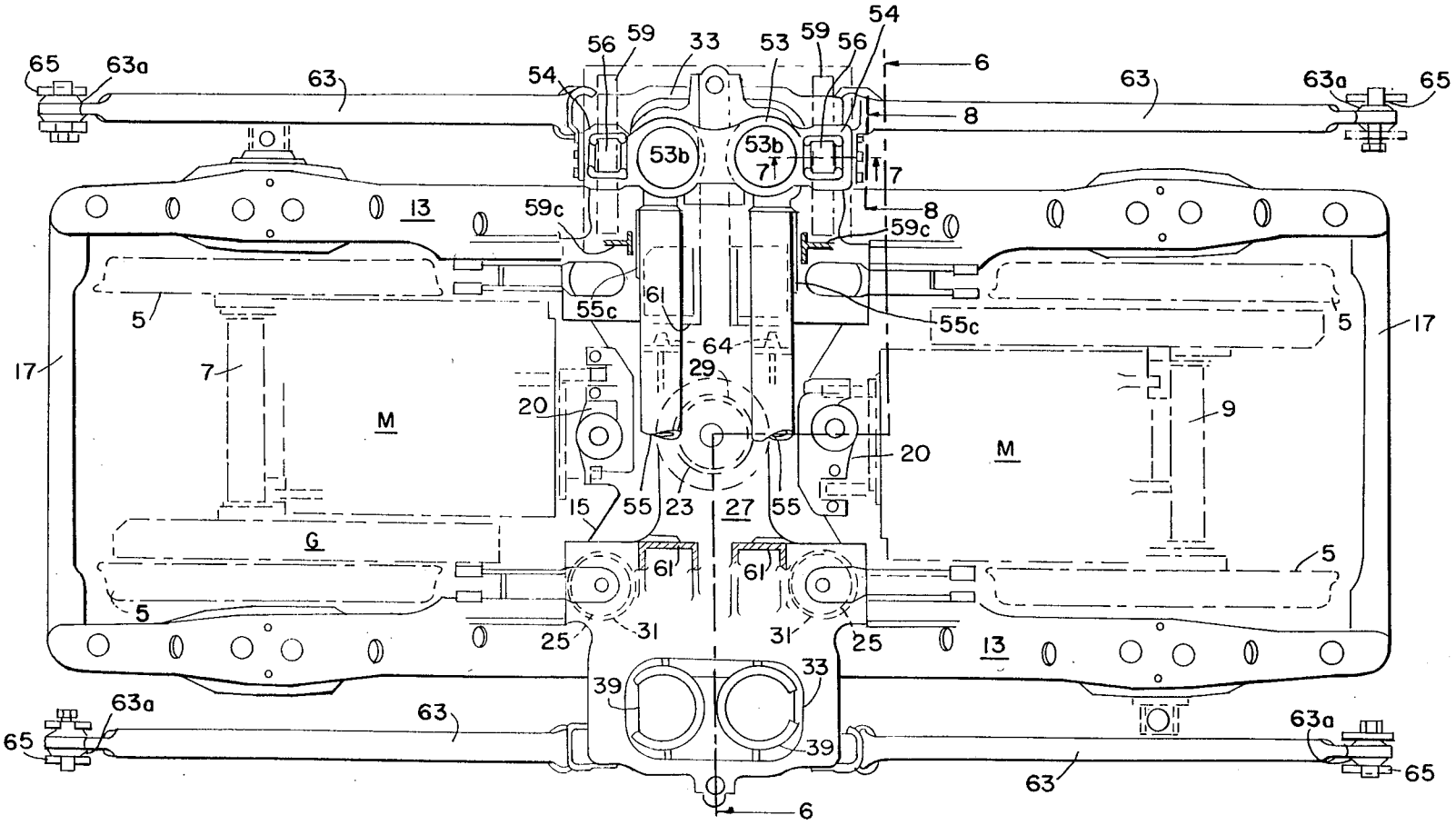
FIG. 3 is a plan view of the intermediate truck taken from lines 3—3 of FIG. 5.
Figure 4:
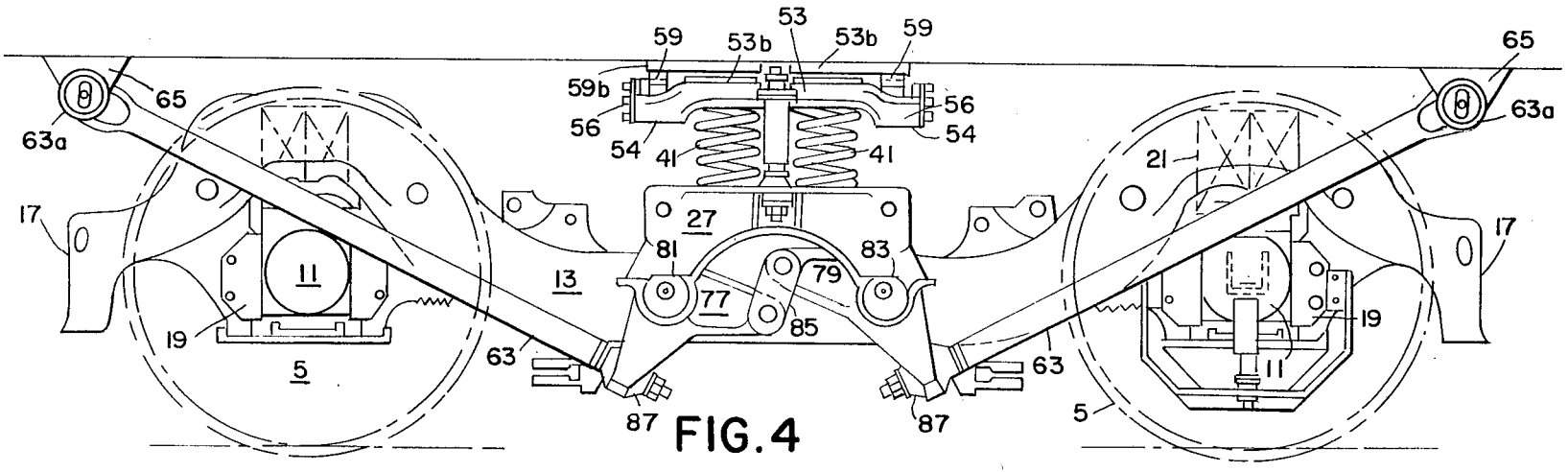
FIG. 4 is a side elevational view of the intermediate truck.

As will be seen from FIGS. 1 and 2, the swivel centers C of the end trucks are maintained close to the center line of the body but the swivel center D of the intermediate truck 3 is arranged to move laterally a much greater distance from the longitudinal center line of the locomotive than the end trucks to permit the locomotive to operate on curved track, during which the intermediate truck 3 must move a substantial distance radially outwardly in accordance with track curvature.

Intermediate truck 3 has railway flanged wheels 5 mounted in gauged pairs on spaced parallel axles 7 and 9. At their ends outboard of wheels 5, axles 7 and 9 are rotatably received in journal boxes 11.

A rigid truck frame, preferably of one-piece cast steel construction comprises a pair of transversely spaced longitudinally extending side members 13 positioned transversely outboard of wheels 5 and rigidly connected to each other by transverse center transom 15 intermediate axles 7 and 9 and end transoms 17, located longitudinally outboard respectively of axles 7 and 9. Frame side members 13 are vertically apertured adjacent journal boxes 11 to form pedestal jaws 19 and journal boxes 11 are vertically slidably received in jaws 19, whereby axles 7 and 9 are maintained transversely of the truck frame. Coil spring units 21 are supported on top of journal boxes 11 and resiliently support frame side members 13 to cushion the frame from vertical shocks and impacts imparted to the wheels by vertical irregularities in the track structure, while opposing tendencies of the frame to tip about a transverse axis.

For driving trucks 3, traction motors M are journaled on axles 7 and 9 and their nose positions are supported by suitable brackets 20 on center transom 15. Gear boxes G drivingly connect motors M to axles 7 and 9 in the usual manner.

For permitting swivel between truck frame 13, 15, 17 and the supported vehicle body underframe U, center transom 15 is formed at its center with a vertical cylindrical recess 23, and inwardly of and adjacent frame members 13, center transom 15 is formed with upwardly facing flat horizontal bearing surfaces 25 spaced apart longitudinally of the truck and symmetrically disposed with respect to the transverse center line of the truck.

A transverse bolster 27 is formed with a depending cylindrical boss 29 pivotally received within recess 23 in transom 15 and is provided with downwardly facing bearing surfaces 31 spaced apart transversely and longitudinally of the truck the same distances as bearing surfaces 25 for slidable support of the bolster on the latter to accommodate swivel about mating boss 29 and recess 23. The transverse and longitudinal spacing of bearing surfaces 25 and 31 prevents tilting of the bolster and truck frame about transverse and longitudinal axes with respect to each other. At its ends transversely outboard of truck frame side members 13, bolster 27 is formed with upwardly open spring pockets 33 in which are mounted upright spring devices, each comprising a sandwich device consisting of a pair of horizontal elastomeric pads 35 bounded by and interleaved with metal plates 37 seated in each pocket 33, an upwardly open spring seat 39 supported on the sandwich devices 35, 37, and an upright metallic coil spring 41 seated in spring seat 39. In addition to providing vertically resilient support for the locomotive body B through vertical deflection, the spring devices yield in horizontal shear transversely of the truck and thereby permit normal lateral movement of the vehicle underframe U relative to the truck to prevent the full force of lateral blows and shocks from being communicated from the rails to the underframe and to prevent momentum of the body from acting with its full lateral force on the truck frame wheel flanges and rails.

Figure 7:
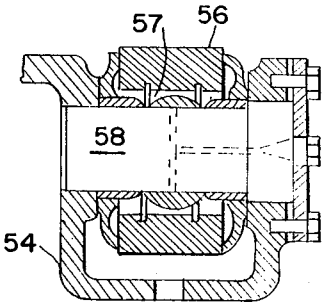
FIG. 7 is an enlarged longitudinal vertical sectional view of a superbolster roller arrangement taken along line 7—7 of FIG. 3.

As in the R. L. Lich patent cited hereinabove, springs 41 of the end trucks 1 (see FIGS. 1 and 7) are received at their upper ends in downwardly open spring caps L37 fixedly secured to the bottom of underframe U, which is thereby capable of vertical movement through vertical deflection of springs L35 and normal lateral motion with respect to bolsters L21 and the respective end truck frames through deflection in horizontal shear of the elastomeric pads and springs L35, such lateral movement of underframe U with respect to the end trucks being limited to normal lateral motion as defined hereinabove, by opposing lateral stops (38, 40 of Lich).

Figure 8:
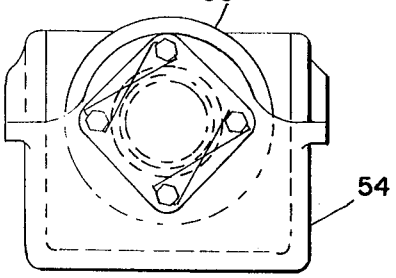
FIG. 8 is a transverse end view of the superbolster roller arrangement taken from line 8—8 of FIG. 3.
Figure 6:
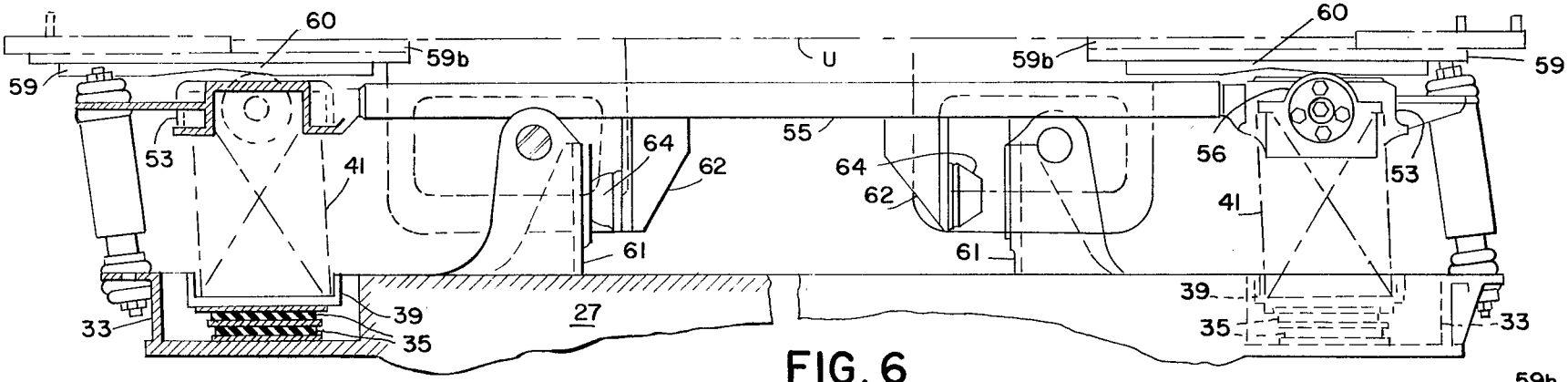
FIG. 6 is a transverse vertical sectional view corresponding to FIG. 5, but taken along lines 6—6 of FIG. 1, showing the intermediate truck parts in their curved track positions.
Figure 5:
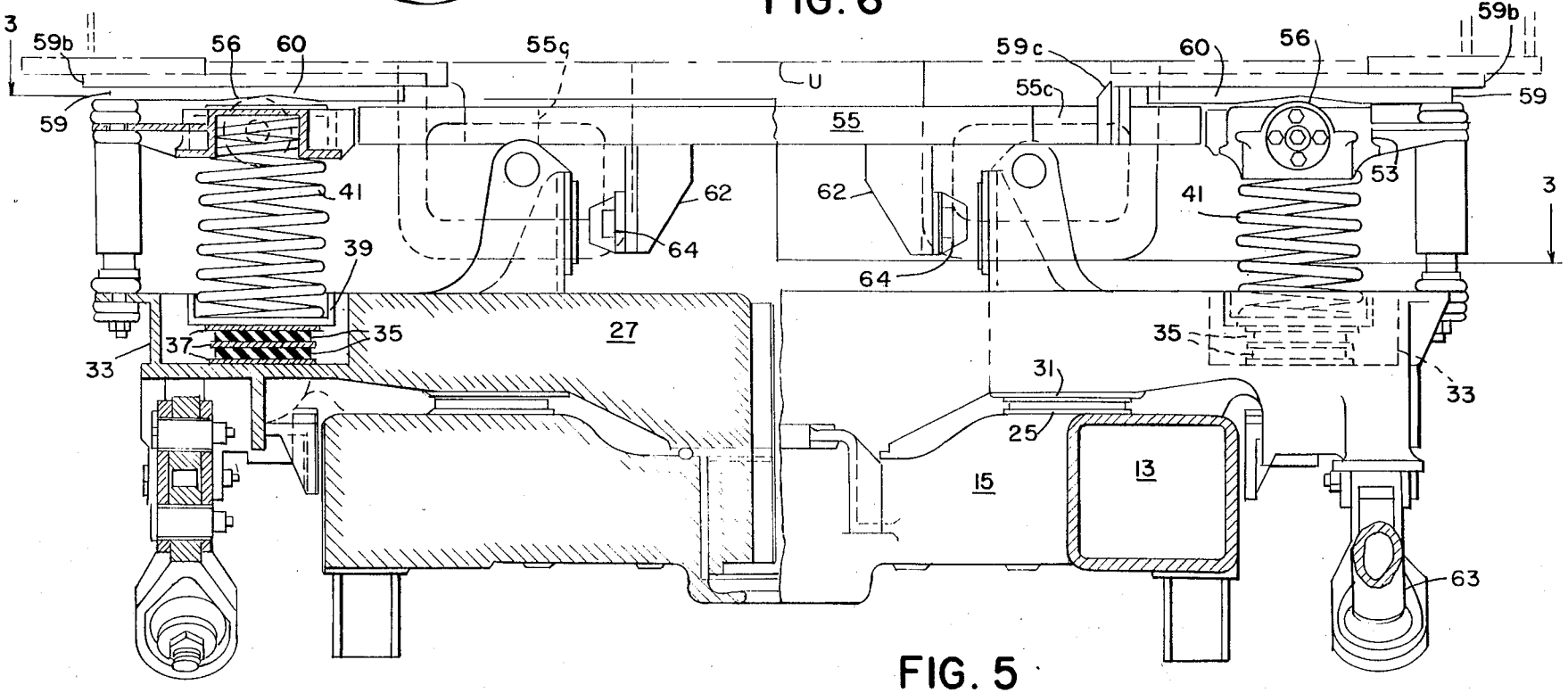
FIG. 5 is a transverse vertical sectional view taken along line 5—5 of FIG. 3, showing the intermediate truck parts in their normal tangent track positions.

In order to permit the required lateral excursion of intermediate truck 3 (FIGS. 1, 3, 5 and 6) with respect to underframe U during operation on curved track, the upper ends of intermediate truck springs 41 are received in downwardly open spring caps 53, which are not rigidly connected to underframe U as are those of the end trucks, and the spring caps 53 at opposite sides of the locomotive are rigidly connected to each other by transverse tubular members 55 to form a rigid superbolster 53, 55. Spring caps 53 are formed at their opposite ends with upwardly open pockets 54 (shown in detail in FIGS. 7 and 8) in which are received rollers 56 mounted via spherical bearings 57 on pins 58 mounted in the transverse walls of spring caps 53 defining roller pockets 54, and underframe U is provided at each side with pairs of longitudinally spaced downwardly facing transversely elongated bearing plates 59 formed with transversely oriented generally V-shaped depressions 60 spaced apart transversely of the truck the same distance as the pivot axes of rollers 56, such that when the locomotive is on tangent track the rollers at both sides of the superbolster will be seated at the apices of depressions 60. Roller bearing plates 59 are secured to the underframe U through plates 59*b*, which overlie and are normally vertically spaced from bearing pads 53*b* on the top of spring caps 53, so that in the event of failure of the rollers 56, bearing pads 53*b* can slidably support the underframe through plates 59*b*. For restricting superbolster 53, 55 to lateral motion only with respect to underframe U, outer surfaces of tubes 55 mount chafing plates 55*c* and opposed lateral guides 59*c* depend from underframe bearing plates 59. Intermediate truck bolster 27 is formed with upstanding inwardly facing lateral stop brackets 61 and superbolster 53, 55 is formed with depending brackets 62, which mount outwardly facing progressive rate bumpers 64 which, as on the end trucks, are transversely spaced a sufficient distance from bolster lateral stop brackets 61 to permit normal lateral movement of the superbolster relative to the bolster. The resistance to lateral motion of the superbolster 53, 55 and underframe U provided by the action of rollers 56 in V-shaped depressions 60 is greater than the shear resistance of springs 41 and pads 35, so that on tangent track all normal lateral motion between underframe U and intermediate truck 3 is accommodated by shear in springs 41 and pads 35, but when the intermediate truck is urged radially outwardly by track curvature beyond the limit of normal lateral motion, the abutting relation of lateral stop brackets 61 and progressive rate bumpers 64 causes the excess of transverse movement beyond normal lateral motion to be transmitted to superbolster 53, 55, thereby causing rollers 56 to roll along slopes of the respective V-shaped depressions 60, increasing the compression on the respective springs 41 as the rollers move along the depression surfaces and permitting the interaction of the track rails and wheel flanges to cause the intermediate truck, and with it, the superbolster, to move transversely outwardly radially of the track curve the full distance required by track curvature, as best seen in FIGS. 1 and 6. Conversely, upon return to tangent track, as the track rails, acting through the wheel flanges, urge the intermediate truck toward transversely centered position, the outer stop brackets 61 on bolster 27 engage the opposing bumpers 64 on the superbolster 53, 55, urging the latter toward centered position transversely of the locomotive underframe U, and the upward pressure of springs 41 on rollers 56 causes the latter to roll up the sloping surface of the V-depressions 60, until the rollers are seated in the apices of the depressions 60 and the superbolster 53, 55 is centered transversely of the locomotive, as seen in FIG. 5.

For transmitting draft and braking forces from the respective trucks to the underframe at a desirably low level, preferably track level, whereby to minimize load transference from one axle to another in each truck, the ends of each bolster 27 are connected to underframe U by longitudinally outwardly and upwardly directed links 63, the axial projections of which converge at rail level so that the resultant of the forces transmitted axially by other anchors at each side is at this level.

The connections of anchor links 61 to underframe U comprise spherical pivot elements **63*a* on the upper ends of the links mounted on brackets 65 on underframe U to hold the links against axial movement while accommodating angling of the links with respect to underframe brackets 65 necessitated by vertical and lateral movements of the underframe relative to the respective truck bolsters. In order to avoid interference by links 63 with operation of springs 41, the ends of bolster 27 are formed with downwardly open pockets and the connections of the links 63 to the bolster ends comprise longitudinal centering and compensating devices, each consisting of a pair of bellcranks with nearly vertical arms 73 and 75 substantially normal to the respective links 63 and nearly horizontal arms 77 and 79 respectively fulcrumed on transverse axes within the downwardly facing bolster pockets by pivot pins 81 and 83. Bellcrank arns 77 and 79 are both directed toward the other bellcrank, the inner end of arm 77 overlying that of arm 79 and being connected to the latter by a nearly vertical link 85, the opposite ends of which are pivotally secured to arms 77 and 79**, respectively.

The inner ends of links 63 are connected to bellcrank arms 73 and 75 respectively by spherical pivot elements 87 to provide the universal angling of traction links 63 with respect to bellcrank arms 73 and 75 necessitated by vertical and lateral movements of underframe U with respect to the truck bolster. With this reverse duplicating motion device, when springs 41 are compressed thus shortening the vertical distance from the underframe to the bolster, the accompanying movement of the inner ends of links 63 toward the other will be accommodated by bellcranks 73, 77 and 75, 79 pivoting respectively counterclockwise and clockwise, and the amounts they pivot will be equal because they are tied to each other by connecting link 85 and no undesired swivel or longitudinal movement will be imparted to bolster 27 relative to underframe U. Similarly when forces tend to move the underframe laterally relative to the bolster 27, the resultant horizontal angling of traction links 63 and accompanying movements of their inner ends away from each other longitudinally of the truck will be accommodated by bellcranks 73, 77 and 75, 79 respectively pivoting clockwise and counterclockwise equal amounts.

The transmission of longitudinal forces from bolster 27 to underframe U will not cause any movement of the bellcranks; e.g., if the truck is being propelled toward the right, compression in the forward draft traction links 61 will tend to pivot bellcrank 75, 79 clockwise and tension in rear link 61 will tend to pivot bellcrank 73, 77 clockwise, but connecting link 85 causes the equal torques of the bellcranks to oppose each other and the bellcranks remain stationary in the absence of vertical or lateral deflection of springs 41 and elastomeric pads 35, as described above.

Under all conditions, the transverse vertical plane through the center of bolster 27 is maintained centered, i.e., equidistant from the underframe U between the inner ends of traction links 63 and the position of truck bolster 27 longitudinally of the underframe is thus fixed because of the fixed location of the connections of traction links 63 to the underframe at brackets 65.

Figure 9:
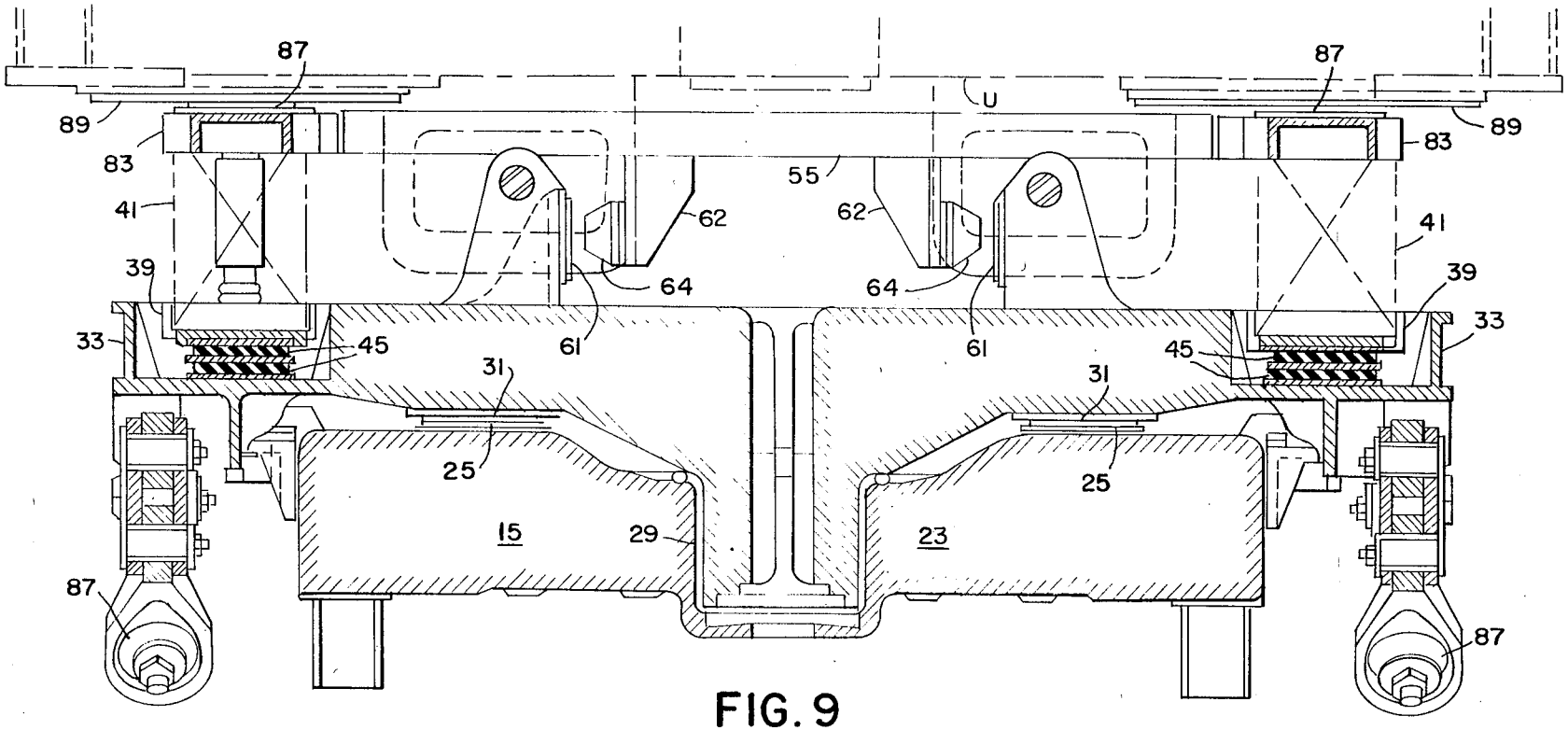
FIG. 9 is a partial transverse vertical sectional view of a modified form of intermediate truck, taken along the transverse center line thereof.

In a modified form shown in FIG. 9, the spring caps 83 of the intermediate axle truck do not have roller pockets or rollers, and directly slidably support underframe U through the slidable engagement of upwardly facing low friction flat bearing surfaces 87 (preferably faced with low friction material such as "Teflon") on the tops of spring caps **53*b* with downwardly facing flat bearing surfaces 89. The frictional resistance between bearing surfaces 87 and 89 is greater than the shear resistance of springs 41 and pads 45 so that on tangent track all normal lateral motion between underframe U and the intermediate truck is accommodated by shear in springs 41 and pads 35, but when the intermediate truck is urged radially outwardly by track curvature beyond the limit of normal lateral outward movement, the movement of lateral stop brackets 61 and progressive rate bumpers 64 causes the excess of transverse movement beyond normal lateral motion to be transmitted to superbolster 83, 55, thereby causing its anti-friction surfaces 87 to slide transversely with respect to underframe bearing surfaces 89 transversely outwardly radially of the track curves sufficiently to permit the intermediate truck to move outwardly the full distance required by track curvature, as best seen in FIG. 1**.

Operation of the locomotive constructed in accordance with the invention is as follows: On tangent track when any lateral blows or shocks are communicated from lateral irregularities in the track rails and through the wheel flanges and truck frames to the truck bolsters 27, spring devices 35, 37, 39, 41 yield in shear transversely of the locomotive and permit sufficient lateral movement of the truck structures relative to the locomotive body to absorb such lateral shocks and prevent their being transmitted into the body. Such lateral movement of the truck bolster with respect to the body is decelerated and stopped by the engagement of either of the lateral stops (38 of Lich) on the respective end truck bolsters with the opposed lateral bumpers (42 of Lich) on the underframe adjacent the end trucks and by the engagement of either of the lateral stop brackets 61 on intermediate truck bolster 27 with the corresponding elastomeric bumper 64 on the superbolster 53, 55 of the intermediate truck. When rounding curves, the lateral motion devices on the end trucks function in the same way as on tangent track, but on the intermediate truck as soon as the track curvature causes the intermediate truck lateral displacement to exceed normal lateral movement (the amount of lateral movement permitted between the lateral stop brackets 61 on the intermediate truck bolster and the progressive rate elastomeric bumper 64 on the superbolster) further rail-initiated displacement of the intermediate truck will cause rollers 56 on the superbolster end portions (spring caps 53) to roll radially outwardly of the track curvature on the inclined surfaces of the respective V-depressions 60 in downwardly facing bearing plates 59 on the underframe a sufficient distance to permit the intermediate truck to move outwardly as fully as is required by track curvature conditions. As the locomotive returns from curved to tangent track or from curved to reverse curve, the lateral stop bracket 61 on the side of the bolster which had been outwardly of the curve will be moved into engagement with the opposing progressive rate elastomeric bumper 64 on the superbolster and will push the superbolster 55, 57 toward its normal position, and the upward pressure of springs 41 on spring caps 53 will tend to cause rollers to move toward their normal tangent track positions seated in the apices of depressions 60, thereby centering the superbolster transversely of the underframe if the locomotive is returning to tangent track operation. In the unlikely event of failure of rollers 56 or roller bearing plates 59, upwardly facing bearing pads **53*b* on intermediate truck spring caps 53 will slidably engage downwardly facing bearing plates 59*b***.

The locomotive, trucks and traction connections between the truck bolsters and the locomotive underframe may be modified in various respects as will occur to those skilled in the art and the exclusive use of all modifications as come within the scope of the appended claims is contemplated.

We claim:

1. In a railway vehicle having a longitudinally elongated body, a pair of end trucks and an intermediate truck supporting said body at points spaced longitudinally thereof, for swivel, vertical and normal lateral motion with respect thereto, each of said trucks having at least two axles spaced apart longitudinally of the truck and a gauged pair of railway flanged wheels on each said axle, said intermediate truck comprising a truck frame supported on said axles, a transversely extending bolster pivotally mounted on said truck frame to swivel about a vertical axis with respect thereto, cooperating means on the transversely spaced ends of said bolster and said body restraining said bolster from movement longitudinally of said body for transmitting traction and braking forces between said intermediate truck and said body, spring devices supported on the ends of said bolster, said spring devices being yieldable transversely of said intermediate truck, a superbolster directly supported on said spring devices, means transversely movably supporting said body on said superbolster, means limiting transverse movement of said superbolster with respect to said bolster to normal lateral motion, said superbolster being movable transversely of the body beyond the limited transverse movement permitted between said superbolster and said bolster to accommodate lateral excursions of said intermediate truck frame with respect to the body in excess of normal lateral motion, required during operation of the vehicle on curved track.

2. In a railway vehicle according to claim 1, said means supporting said body on said superbolster providing lateral resistance between said superbolster and said body exceeding the horizontal shear resistance of said spring devices whereby normal lateral movements of said body are accommodated between said superbolster and said bolster by lateral shear in said spring devices and lateral excursions of said intermediate truck in excess of normal lateral movements are accommodated between said superbolster and said body.

3. In a railway vehicle according to claim 2, wherein said supporting means comprise rollers rotatably mounted on said superbolster at opposite sides of said intermediate truck, with their axes longitudinal of the truck and bearing elements on said body having downwardly open generally V-shaped depressions seated at their apices on said rollers when the truck is centered.

4. In a railway vehicle according to claim 3, said superbolster being formed with upwardly opened pockets in its end portions and said rollers being rotatably mounted in said pockets.

5. In a railway vehicle according to claim 4, longitudinally extending cylindrical elements mounted in said pockets and having convex spherical surfaces, rollers having mating concave spherical surfaces slidably receiving said convex surfaces to permit angling of said rollers relative to said cylindrical means, whereby to accommodate said rollers to possible misalignments of said body bearing elements.

6. In a railway vehicle according to claim 5, a pair of said pockets spaced apart longitudinally of the truck in the transversely spaced end portions of said superbolster, and correspondingly spaced rollers in the respective pockets, said body having a correspondingly spaced pair of bearing elements at each side.

7. In a railway vehicle according to claim 3, downwardly facing bearing plates on said body and upwardly facing opposing horizontal bearing surfaces on said superbolster, said body bearing plates and said superbolster upwardly facing bearing surfaces being normally vertically spaced from each other and adapted for slidable body-supporting engagement in the event of said rollers and opposing body bearing elements becoming inoperative to support said body.

8. In a railway vehicle according to claim 1, opposing transverse vertical surfaces on said superbolster and said body for restraining said superbolster to movement transversely of said body.

9. In a railway vehicle according to claim 1, said spring devices including elastomeric pad elements transversely yieldable in shear.

10. In a railway vehicle according to claim 9, said spring devices including upright metal coil springs in series with said elastomeric pad elements.

11. In a railway vehicle according to claim 10, said elastomeric pad elements being seated on said truck bolster and seats for said coil springs being seated on said elastomeric pad elements.

12. In a railway vehicle according to claim 1, said transverse movement limiting means comprising opposing lateral stop elements on said bolster and said superbolster.

13. In a railway vehicle according to claim 12, said lateral stop devices including progressive rate elastomeric bumpers.

14. In a railway vehicle according to claim 13, said lateral stop devices including a pair of transversely inwardly facing upright brackets on said bolster and depending outwardly facing brackets on said superbolster, said outwardly facing brackets being in transversely spaced relation with said inwardly facing brackets.

15. In a railway vehicle according to claim 14, said outwardly facing brackets mounting said elastomeric bumpers.

16. In a railway vehicle according to claim 1, said superbolster having upwardly facing horizontal bearing surfaces at both its ends, said body having downwardly facing flat bearing surfaces in opposed slidable relation with said upwardly facing bearing surfaces.

17. In a railway vehicle according to claim 16, a low friction surface material between said upwardly facing bearing surfaces and said downwardly facing bearing surfaces to reduce frictional resistance and facilitate sliding relation between said body and said superbolster.

18. In a railway vehicle according to claim 1, said cooperating means comprising a pair of links at each side of the vehicle pivotally connected at one end to the respective end of the bolster and at their other end to said body, said links being inclined symmetrically longitudinally of the truck such that their axial projections intersect in the region of rail level.

19. In a raiway vehicle according to claim 18, said connections of said links to said bolster comprising mechanisms accommodating vertical movements of the body on the spring devices, the connections of said links to said mechanisms including spherical pivots to accommodate lateral motion and lateral excursions of said truck with respect to the body.

20. In a railway vehicle truck, a pair of axles spaced apart longitudinally, a gauged pair of railway flanged wheels on each said axle, a truck frame supported on said axles, a transversely extending bolster pivotally mounted on said truck frame to swivel about a vertical axis with respect thereto, spring devices supported on the ends of said bolster and being yieldable transversely of said truck, a superbolster directly supported on said spring devices, means transversely movably supporting the vehicle body on said superbolster, means limiting transverse movement of said superbolster with respect to said bolster to normal lateral motion, said body-supporting means accommodating movement of the superbolster transversely of the body beyond the limited transverse movement permitted between said superbolster and said bolster to accommodate lateral excursions of said truck frame with respect to the body in excess of normal lateral motion.

21. In a railway vehicle truck according to claim 20, said means supporting the vehicle body on said superbolster providing lateral resistance between said superbolster and the vehicle body exceeding the horizontal shear resistance of said spring devices whereby normal lateral movements of the vehicle body are accommodated between said superbolster and said bolster by lateral shear in said spring devices and lateral excursions of said intermediate truck in excess of normal lateral movements are accommodated between said superbolster and the vehicle body.

22. In a railway vehicle truck according to claim 21, wherein said supporting means comprise rollers rotatably mounted on said superbolster at opposite sides of said intermediate truck, with their axes longitudinal of the truck and bearing elements affixed to the vehicle body having downwardly open generally V-shaped depressions seated at their apices on said rollers when the truck is centered.

23. In a railway vehicle truck according to claim 22, said superbolster being formed with upwardly opened pockets in its end portions and said rollers being rotatably mounted in said pockets 24. In a railway vehicle truck according to claim 23, longitudinally extending cylindrical elements mounted in said pockets and having convex spherical surfaces, rollers having mating concave spherical surfaces slidably receiving said convex surfaces to permit angling of said rollers relative to said cylindrical means, whereby to accommodate said rollers to possible misalignments of said bearing elements.

25. In a railway vehicle truck according to claim 24, a pair of said pockets spaced apart longitudinally of the truck in the transversely spaced end portions of said superbolster, correspondingly spaced rollers in the respective pockets, and a correspondingly spaced pair of bearing elements affixed to the vehicle body at each side.

26. In a railway vehicle truck according to claim 22, downwardly facing bearing plates affixed to the body and upwardly facing opposing horizontal bearing surfaces on said superbolster, said body bearing plates and said superbolster upwardly facing bearing surfaces being normally vertically spaced from each other and adapted for slidable body-supporting engagement in the event of said rollers and opposing body bearing elements becoming inoperative to support the body.

27. In a railway vehicle truck according to claim 20, said spring devices including elastomeric pad elements transversely yieldable in shear.

28. In a railway vehicle truck according to claim 27, said spring devices including upright metal coil springs in series with said elastomeric pad elements.

29. In a railway vehicle truck according to claim 28, said elastomeric pad elements being seated on said truck bolster and seats for said coil spring being seated on said elastomeric pad elements.

30. In a railway vehicle truck according to claim 20, said transverse movement limiting means comprising opposing lateral stop elements on said bolster and said superbolster.

31. In a railway vehicle truck according to claim 30, said lateral stop devices including progressive rate elastomeric bumpers.

32. In a railway vehicle truck according to claim 31, said lateral stop devices including a pair of transversely inwardly facing upright brackets on said bolster and depending outwardly facing brackets on said superbolster, said outwardly facing brackets being in transversely spaced relation with said inwardly facing brackets.

33. In a railway vehicle truck according to claim 20, said superbolster having upwardly facing horizontal bearing surfaces at both its ends, downwardly facing flat bearing surfaces affixed to the vehicle body in opposed slidable relation with said upwardly facing bearing surfaces.

34. In a railway vehicle truck according to claim 33, a low friction surface material between said upwardly facing bearing surfaces and said downwardly facing bearing surfaces to reduce frictional resistance and facilitate sliding relation between the body and said superbolster.

35. In a railway vehicle truck according to claim 20, a pair of longitudinally extending links at each side of the truck each pivotally connected at its one end to the respective end of the bolster, and means for pivotally connecting it at its other end to the body, whereby said links are inclined symmetrically longitudinally of the truck such that their axial projections intersect in the region of rail level.

36. In a railway vehicle truck according to claim 35, said connections of said links to said bolster comprising mechanisms accommodating vertical movements of the body on the spring devices, the connections of said links to said mechanisms including spherical pivots to accommodate lateral motion and lateral excursions of said truck with respect to the body.

* * * * *